US006869071B2

(12) United States Patent
Amamoto et al.

(10) Patent No.: US 6,869,071 B2
(45) Date of Patent: Mar. 22, 2005

(54) SHEET SUPPLY CASSETTE AND IMAGE FORMING APPARATUS

(75) Inventors: Hidekazu Amamoto, Saitama (JP); Yuichi Takamori, Saitama (JP); Toru Ozawa, Saitama (JP); Shinya Hara, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 206 days.

(21) Appl. No.: 10/383,248

(22) Filed: Mar. 7, 2003

(65) Prior Publication Data

US 2004/0051231 A1 Mar. 18, 2004

(30) Foreign Application Priority Data

Sep. 17, 2002 (JP) ..... P2002-270052

(51) Int. Cl.[7] ..... B65H 1/04
(52) U.S. Cl. ..... 271/145; 271/171
(58) Field of Search ..... 271/145, 171; 399/111, 113; 220/4.03, 8; 312/34.1, 34.4, 330.1; 206/449, 555, 556

(56) References Cited

U.S. PATENT DOCUMENTS 5,172,903 A * 12/1992 Haneda et al. ..... 271/171
5,537,195 A * 7/1996 Sagara et al. ..... 399/381
5,700,003 A * 12/1997 Sung ..... 271/110
6,206,362 B1 * 3/2001 Tan et al. ..... 271/145

FOREIGN PATENT DOCUMENTS

| | | | |
|---|---|---|---|
| EP | 0.529.803 A2 * | 3/1993 | G03G/15/00 |
| JP | 5-51136 | 3/1993 | B65H/1/26 |
| JP | 6-271141 | 9/1994 | B65H/7/04 |
| JP | 10-194479 | 7/1998 | B65H/1/26 |
| JP | 11-292311 A * | 10/1999 | B65H/1/26 |

* cited by examiner

*Primary Examiner*—Donald P. Walsh
*Assistant Examiner*—Mark J. Beauchaine
(74) *Attorney, Agent, or Firm*—Morgan Lewis & Bockius LLP

(57) ABSTRACT

A sheet supply cassette includes a main frame body and an auxiliary frame body slidable with respect to the main frame body. In the main frame body, there is disposed a sheet placement plate which moves up and down according to the residual quantity of sheets placed, and there is disposed a sheet residual quantity display mechanism which displays the sheet residual quantity according to the upward and downward movements of the sheet placement plate. The display mechanism includes a sheet residual quantity detect portion for detecting the residual quantity of sheets, a sheet residual quantity display portion disposed on the front surface cover portion of the auxiliary frame body, and a connecting portion for connecting together the sheet residual quantity detect portion and sheet residual quantity display portion, while the connecting portion can be expanded and contracted according to the expansion and contraction of the sheet supply cassette.

10 Claims, 6 Drawing Sheets

SHEET SUPPLY CASSETTE AND IMAGE FORMING APPARATUS

BACKGROUND OF THE INVENTION

1. Field of the Invention

The present invention relates to a sheet supply cassette for storing sheets therein and an image forming apparatus of an electrophographic type including the sheet supply cassette.

2. Description of the Related Art

As a sheet supply cassette for use in an image forming apparatus, there is known a sheet supply cassette which includes a main frame body and an auxiliary frame body slidably disposed on the main frame body, while the auxiliary frame body can be made to expand and contract according to the size of sheets to be stored (see JP-A-5-51136). And, there is also known a sheet residual quantity-mechanism which detects the residual quantity of sheets in the sheet supply cassette to display the sheet residual quantity in the sheet supply cassette (see JP-A-6-271141 and JP-A-10-194479).

However, conventionally, there is not known a technique in which a sheet residual quantity display mechanism is applied to an expandable and contractible sheet supply cassette. Since the conventional sheet residual quantity display mechanism is structured such that it moves a residual quantity display portion connected to a sheet placement plate for placing sheets thereon, in case where this mechanism is applied to a sheet supply cassette which is structured so as to be expandable and contractible, the sheet residual quantity display portion must be disposed on a main frame body on which the sheet placement plate is disposed. In case where a sheet supply cassette is mounted on an image forming apparatus, when the auxiliary frame body is situated on the front surface side and the main frame body is situated on the deep side, the structure including the sheet residual quantity display portion on the main frame body raises a problem that a user is hard to see the sheet residual quantity display portion to make it difficult to confirm the sheet residual quantity.

SUMMARY OF THE INVENTION

The invention has been made in view of the above circumstances, and therefore an object of the invention is to provide an expandable and contractible sheet supply cassette which allows easy confirmation of the residual quantity of sheets in the cassette, and an image forming apparatus including such sheet supply cassette.

In attaining the above object, according to a first aspect of the invention, there is provided a sheet supply cassette, comprising: a main frame body; an auxiliary frame body disposed so as to be slidable with respect to the main frame body; a sheet residual quantity detect portion movable according to the residual quantity of sheets placed; a connecting portion connected to the sheet residual quantity detect portion and movable according to the sliding movement of the auxiliary frame body; and, a sheet residual quantity display portion disposed in the auxiliary frame body for displaying the detect result of the sheet residual quantity detect portion. Therefore, since the sheet residual quantity display portion can be disposed in the auxiliary frame body, even in case where the main frame body is disposed on the deep side, the sheet residual quantity can be confirmed easily.

Preferably, in the main frame body, there may be disposed a sheet placement plate for placing sheets thereon and the connecting portion may be connected to the sheet placement plate. In the sheet placement plate, there is disposed a mechanism which allows the sheet placement plate to be rotated, inclined and moved up and down according to the residual quantity of sheets, while such movements of the sheet placement plate can be detected by the sheet residual quantity detect portion. In this case, the sheet residual quantity detect portion can be rotated according to the sheet residual quantity and the rotation of the sheet residual quantity can be transmitted through the connecting portion to the sheet residual quantity display portion. Preferably, a lever may be disposed in one of the connecting portion and sheet residual quantity display portion, and a cam may be disposed in the other, so that the rotation of the connecting portion can be converted to the vertical motion of a display piece disposed on the sheet residual quantity display portion.

The connecting portion, preferably, maybe fixed in position so that only the rotation of the connecting portion can be allowed by a support portion formed in the auxiliary frame body. In the case of the connecting portion, there is a fear that, when the auxiliary frame body is to be expanded, a user can touch the connection portion directly; and, therefore, preferably, there maybe formed a protection portion in the connecting portion. This protection portion can be formed as an eaves-like protection wall to be disposed in the upper portion of the connecting portion, or can be formed as a protection cover which surrounds the connecting portion.

According to another aspect of the invention, there is provided an image forming apparatus, comprising: an image forming apparatus main body; image forming means stored in said image forming apparatus main body; and, a sheet supply cassette for storing therein sheets to be transported to the image forming means, the sheet supply cassette, comprising: a main frame body; an auxiliary frame body disposed so as to be slidable with respect to the main frame body; a sheet residual quantity detect portion movable according to the residual quantity of sheets placed; a connecting portion connected to the sheet residual quantity detect portion and movable according to the slidable movement of the auxiliary frame body; and, a sheet residual quantity display portion disposed in the auxiliary frame body for displaying the detect result of the sheet residual quantity detect portion, wherein, when the auxiliary frame body is expanded, at least part of the auxiliary frame body is projected further than the image forming apparatus main body on the front surface side of the auxiliary frame body. In this structure, since the auxiliary frame body of the sheet supply cassette is formed so as to be able to project further than the image forming apparatus main body, when storing sheets of a small size in the sheet supply cassette, the sheet supply cassette can be, contracted to thereby make the image forming apparatus compact as a whole; for sheets of a large size, by expanding the sheet supply cassette, the large-sized sheets can be stored. Also, in case where the sheet supply cassette is expanded and contracted in this manner, the sheet residual quantity can be confirmed by the sheet residual quantity display portion disposed in the auxiliary frame body.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

Next, description will be given below of an embodiment according to the invention with reference to the accompanying drawings.

Figure 1:
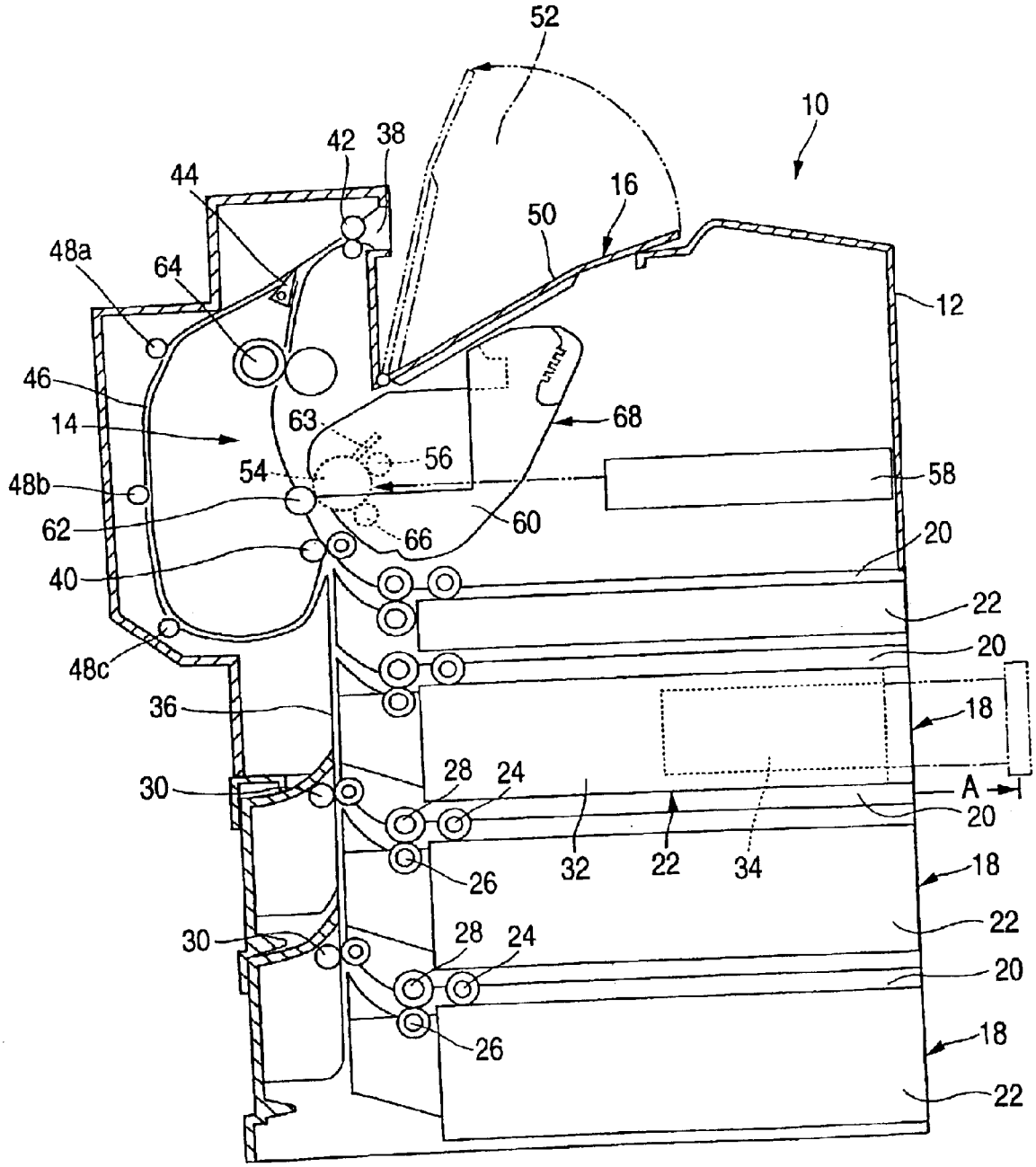
FIG. 1 is a section view of an image forming apparatus according to an embodiment of the invention.

FIG. 1 shows a general view of an image forming apparatus 10 according to an embodiment of the invention. The image forming apparatus 10 includes an image forming apparatus main body 12; in the interior of the image forming apparatus main body 12, there is stored image forming means 14; in the upper portion of the image forming apparatus main body 12, there is disposed a discharge portion 16 which will be discussed later; and, in the lower portion of the image forming apparatus main body 12, there are disposed, for example, two stages of sheet supply units 18, 18. Further, below the image forming apparatus main body 12, there are disposed another two stages of sheet supply units 18, 18 which can be removably mounted as options.

Each of the sheet supply units 18 includes a sheet supply unit main body 20 and a sheet supply cassette 22 for storing sheets therein. The sheet supply cassette 22 is slidably mounted on the sheet supply unit main body 20 and can be pulled out in the front portion of the sheet supply unit main body 20 (in FIG. 1, in the right direction). Also, in the upper portion of the sheet supply cassette 22 that is situated adjacent to the deep end of the sheet supply cassette 22, there is disposed a nudger roller 24; and, in front of the nudger roller 24, there are disposed a retard roller 26 and a feed roller 28. Further, in each of the sheet feed units 18, 18 to be used as the options, there are disposed a pair of feed rollers 30.

At least one of the above-mentioned plurality of sheet supply cassettes 22 is structured so as be expandable and contractible and comprises a main frame body 32 and an auxiliary frame body 34 which is mounted so as to be slidable with respect to the main frame body 32; and, as shown by a two-dot chained line in FIG. 1, when expanded, the auxiliary frame body 34 can be projected at least by a length A (which corresponds to a portion of the auxiliary frame body 34) in the front direction from the image forming apparatus main body 12 and, when contracted, it can coincide with the front wall surface of the image forming apparatus main body 12. Description will be given later in more detail of the sheet supply cassette 22.

A transport passage 36 is a sheet passage which extends from the nudger roller 24 of the sheet supply unit 18 situated in the lower-most end of the image forming apparatus main body 12 to a discharge opening 38; and, the transport passage 36 includes a substantially vertical portion which exists in the vicinity of the back surface (in FIG. 1, the left side surface) of the image forming apparatus main body 12 and extends from the feed roller 30 of the lower-most-end sheet supply unit 18 to a fixing device 62 (which will be discussed later). On the upstream side of the transfer device 62 of the transport passage 36, there are disposed a charging device 56 and an image carrier body 54 (both of which will be discussed later) and, on the upstream side of the of these transfer device 56 and image carrier body 54, there is disposed a resist roller 40. Further, in the vicinity of the discharge opening 38 of the transport passage 36, there is disposed a discharge roller 42.

Accordingly, the sheet transported from the sheet supply unit 18 is caused to stop temporarily by the resist roller 40 of the transport passage 36, is then transported at a given timing to the image forming means 14 where an image is formed on the sheet, and is next discharged to the discharge portion 16.

However, in case where the sheet is to be printed on both sides thereof, the sheet is returned to a reversing passage. That is, the transport passage 36 is formed so as to fork to two passages in front of the discharge roller 42; in the forked portion, there is disposed a switching pawl 44; and, there is formed a reversing passage 46 which is formed so as to return to the resist roller 42 from the forked portion. In the reversing passage 46, there are disposed transport rollers 48*a*–48*c*. In the case of the both-side printing, the switching pawl 44 is switched over to the side for opening the reversing passage 46; at the time when the portion of the sheet that exists just before the rear end of the sheet reaches the discharge roller 42, the discharge roller 42 is reversed; a recording medium is introduced into the reversing passage 46; and, the sheet is transported through the resist roller 38, transfer device 62, image carrier body 54 and fixing device 62, and is then discharged to the discharge portion 16.

The discharge portion 16 includes an inclined portion 50 which can be rotated with respect to the image forming apparatus main body 12. The inclined portion 50 is structured in the following manner: that is, it is low in a discharge opening portion thereof, it is inclined so as to increase gradually in height toward the front surface direction (in FIG. 1, the right direction); and, the discharge opening portion serves as the lower end of the inclined portion 50, whereas the height most-increased portion serves as the upper end thereof. The inclined portion 50 is supported on the image forming apparatus main body 12 in such a manner that it can be rotated about the lower end thereof. As shown by a two-dot chained line in FIG. 1, when the inclined portion 50 is opened upwardly, an opening portion 52 is formed, so that a process cartridge 66 (which will be discussed later) can be mounted and removed through the opening portion 52.

The image forming means 14 may be formed as, for example, image forming means of an electrophotographic type which comprises: an image carrier body 54 formed of a photo conductor; a charging device 56 made of, for example, a charging roller for charging the image carrier body 54 uniformly; a light writing device 58 for writing a latent image on the image carrier body 54 charged by the charging device 56 using the light; a developing device 60 for visualizing the latent image of the image carrier body 54 formed by the light writing device 58 using a developing agent; a transfer device 62 composed of, for example, a transfer roller for transferring the developing-agent image formed by the developing device 60 to a sheet; a cleaning device 63 composed of, for example, a blade for cleaning the developing agent remaining on the image carrier body 54; and, a fixing device 64 composed of, for example, a pressurizing roller and a heating roller for fixing the developing-agent image on the sheet transferred by the transfer device 62 onto the sheet. The light writing device 58 is composed of, for example, a laser exposure device of a scan type, is disposed in parallel to the above-mentioned sheet supply units 18 in the vicinity of the front surface of the image forming apparatus main body 12, and exposes the image carrier body 54 across the interior of the developing device 60. Also, the developing device 60 includes a developing roller 66 which is disposed opposed to the image carrier body 54.

A process cartridge 68 is an integrated body in which the image carrier body 54, charging device 56, developing device 60 and cleaning device 64 are united together. The process cartridge 68 is disposed just below the inclined portion 50 of the discharge portion 16 and, as described before, can be mounted and removed through the opening portion 52 that is to be formed when the inclined portion 50 is opened.

Figure 2:
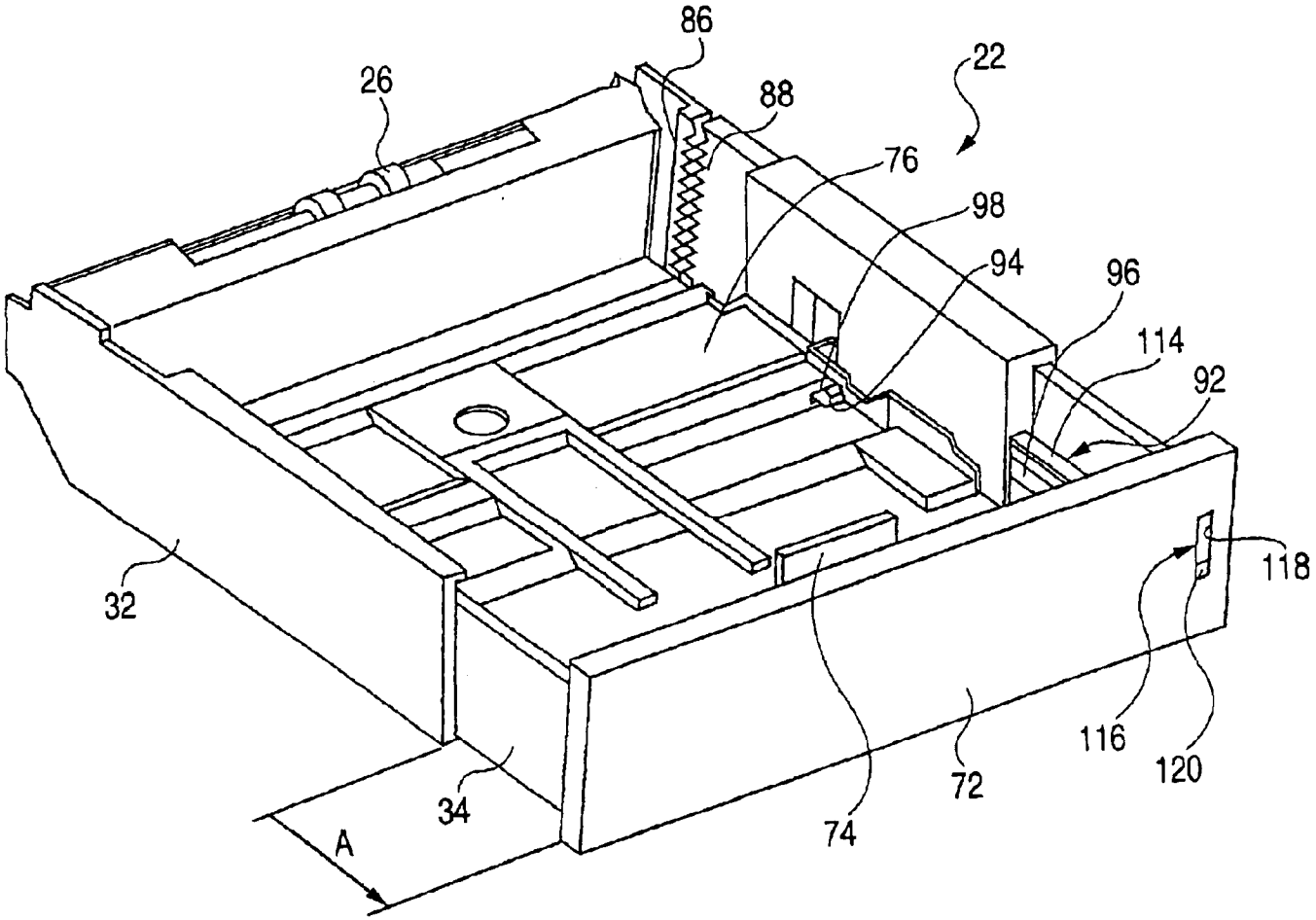
FIG. 2 is a perspective view of a sheet supply cassette used in the image forming apparatus according to the embodiment of the invention, when viewed from above the front surface thereof.
Figure 3:
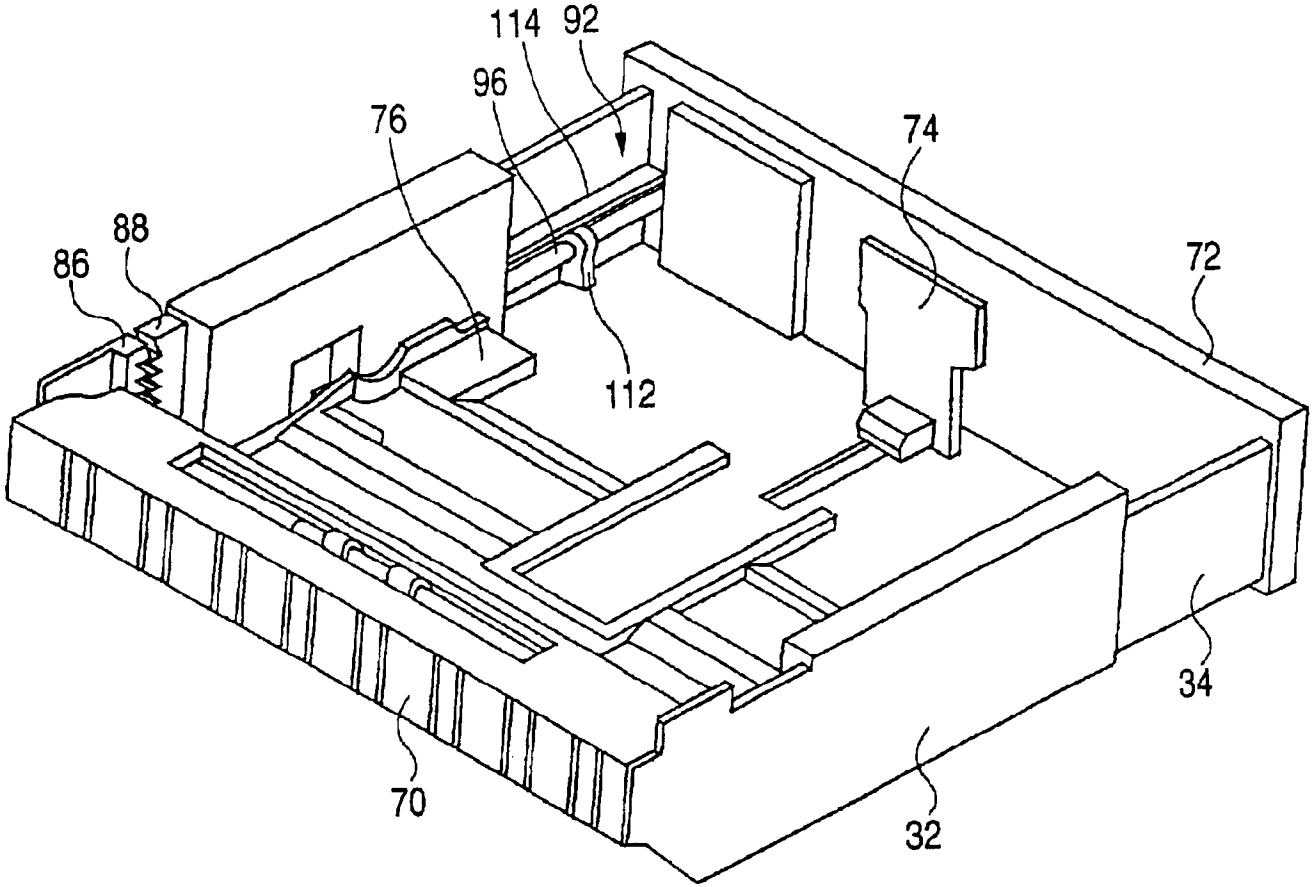
FIG. 3 is a perspective view of the sheet supply cassette used in the image forming apparatus according to the embodiment of the invention, when viewed from above the back surface thereof.

In FIGS. 2 and 3, there is shown an example of the sheet supply cassette 22. The main frame body 32 supports the retard roller 26 on the insertion-direction deep side of the sheet supply cassette 22. Also, in the back surface portion of the main frame body 32, there is formed a guide portion 70 which is used to guide the sheet. The side surface portion of the auxiliary frame body 34 is slidably inserted into the side surface portion of the main frame body 32. The auxiliary frame body 34 includes a front surface cover portion 72 in the front surface portion thereof; and, the front surface cover portion 72 can be projected out from the image forming apparatus main body by the length A. Also, in the interior of the auxiliary frame body 34, there is erected a sheet rear end guide 74 in such a manner that it can be moved in the back and forth direction. When a sheet is stored into the sheet supply cassette 22, the rear end of the sheet is contacted with the sheet rear end guide 74. When storing sheets differing in size, the auxiliary frame body 34 may be expanded and contracted with respect to the main frame body 32; and, in a state where the auxiliary frame body 34 is expanded, the sheet rear end guide 74 may be moved and adjusted.

On the bottom portion of the main frame body 32, there is disposed a sheet placement plate 76 in such a manner that it can be oscillated. This sheet placement plate 76 can be moved up and down according to the residual quantity of sheets stored and, in the sheet placement plate 76, there is provided a control mechanism which is used to always keep constant the transport position of the sheet that is placed on the upper-most position of the sheet placement plate 76.

This control mechanism may be composed of an electrically operated mechanism which detects the position of the nudger roller 24 electrically and drives the sheet placement plate 76 using a motor. However, in the present embodiment, there is used a mechanically operated mechanism; and, an example of this mechanism is shown in FIG. 4.

Figure 4:
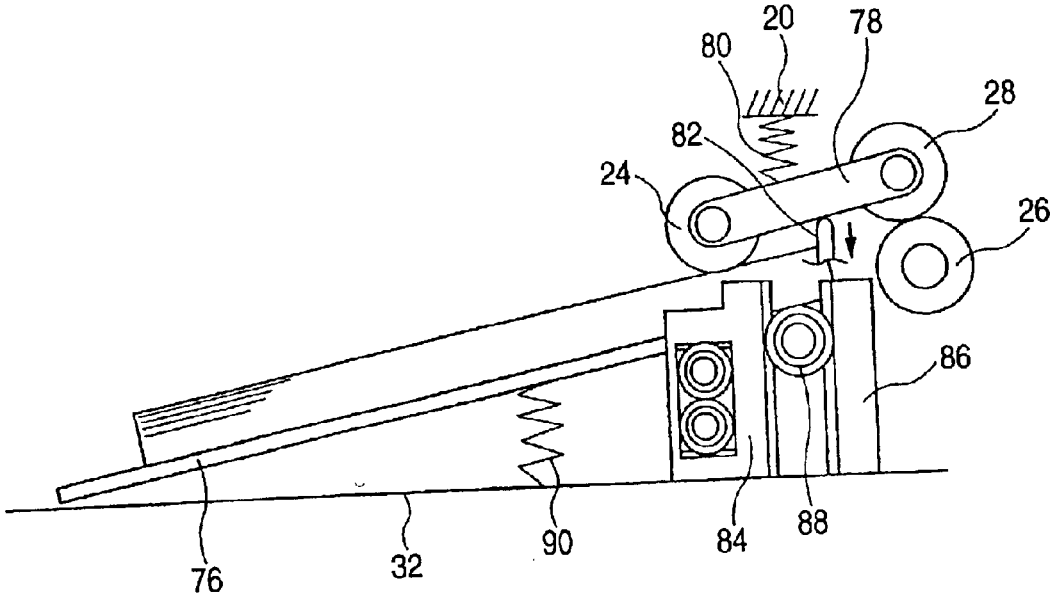
FIG. 4 is a side view of a position control mechanism for controlling the position of the sheet supply cassette used in the image forming apparatus according to the embodiment of the invention.
Figure 5:
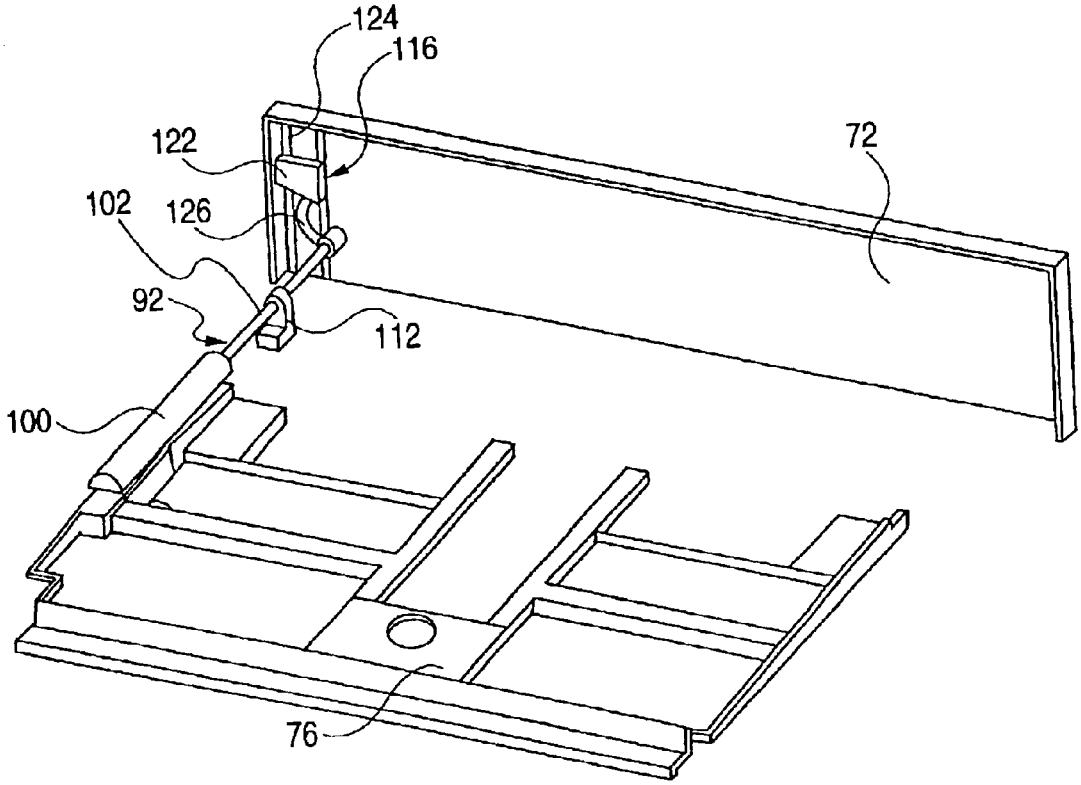
FIG. 5 is a perspective view of the main portions of the sheet supply cassette according to the embodiment of the invention, when viewed from the back surface direction.
Figure 6:
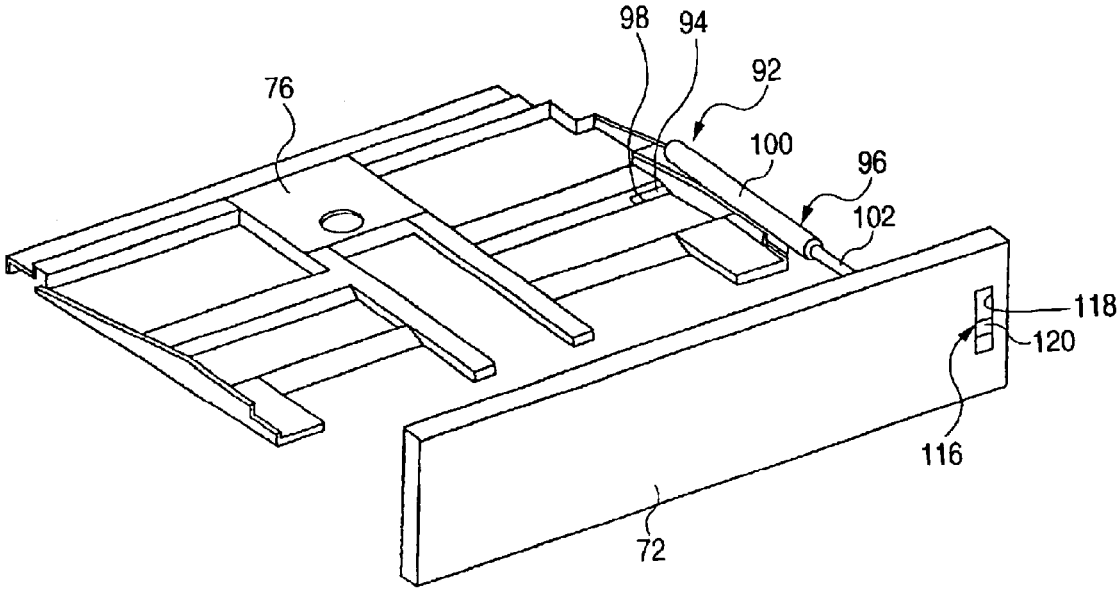
FIG. 6 is a perspective view of the main portions of the sheet supply cassette according to the embodiment of the invention, when viewed from the front surface direction.
Figure 7:
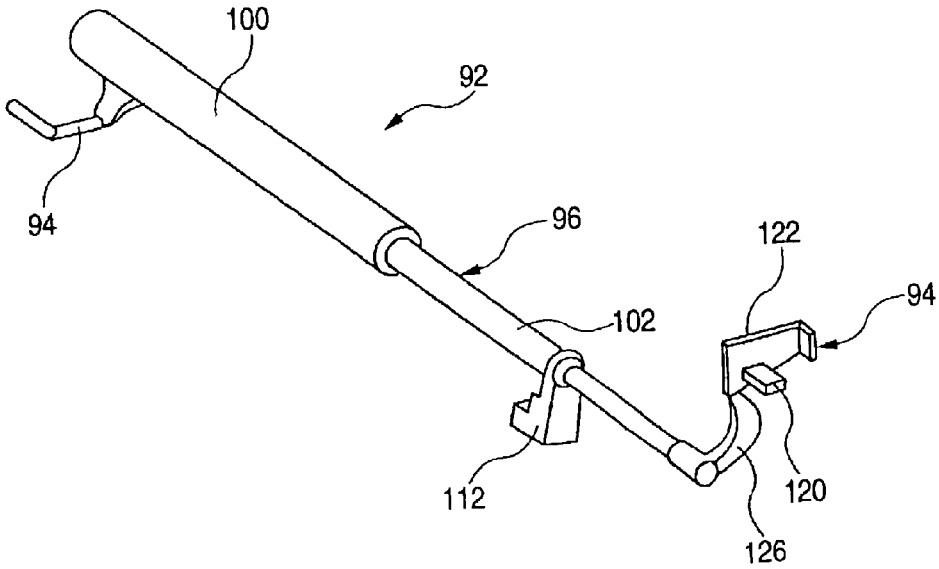
FIG. 7 is a perspective view of a sheet residual quantity display mechanism used in the sheet supply cassette according to the embodiment of the invention.

In FIG. 4, the nudger roller 24 is supported on an oscillatory arm 78 which can be oscillated with the rotary shaft of the feed roller 28 as a fulcrum thereof. This oscillatory arm 78 is energized downwardly from above by a first elastic member 80. Also, with the oscillatory arm 78, there is contacted an actuator 82 which is used to detect the position of the oscillatory arm 78; and, to the actuator 82, there is connected a ratchet 84. This ratchet 84 can be moved in the right and left direction with respect to the main frame body 32; and, a rack 86 is fixed to the main frame body 32 in such a manner that it is disposed opposed to the ratchet 84. A pinion gear 88 is meshingly engaged with the ratchet 84 and rack 86. This pinion gear 88 is rotatably supported on the sheet placement plate 76. Also, between the sheet placement plate 76 and main frame body 32, there is interposed a second elastic member 90; and, the sheet placement plate 76 is energized by the second elastic member 90 such that it ascends toward the sheet feed-out side thereof.

When the ratchet 84 is situated on the right in FIG. 4, since the pinion gear 88 is meshingly engaged with the ratchet 84 and rack 86, the position of the sheet placement plate 76 is fixed. The nudger roller 24 is pressed against sheets piled up on the sheet placement plate 76 with a given level of pressure by the first elastic member 80. Here, in case where the sheets are fed out from the sheet placement plate 76 due to the rotation of the nudger roller 24 and they are then handled and transported one by one by the retard roller 26 and feed roller 28, the oscillatory arm 78 is moved downwardly. With such downward motion of the oscillatory arm 78, the actuator 82 is pushed by the oscillatory arm 78 and is thereby moved downwardly, so that the ratchet 84 is moved in the left direction in FIG. 4. This removes the meshing engagement between the ratchet 84 and pinion gear 88, the pinion gear 88 is rotated along the rack 86 by the second elastic member 90, and the sheet placement plate 76 is moved upwardly. Due to this, the actuator 82 is moved upwardly until it balances with the first elastic member 80. As a result of this, the ratchet 84 moves to the right in FIG. 4 and is meshingly engaged with the pinion gear 88, the upward movement of the sheet placement plate 76 is stopped, and the nudger roller 24 is again contacted with the sheet at a given position.

In this manner, the sheet placement plate 76 is moved up and down according to the sheet residual quantity. In the present embodiment, there is disposed a sheet residual quantity display mechanism 92 which is used to display the residual quantity of sheets according to the upward and downward movements of the sheet placement plate 76.

In FIGS. 5 to 9, the sheet residual quantity display mechanism 92 is disposed in the vicinity of the inner surface of the side portion of the sheet supply cassette 22 and includes a sheet residual quantity detect portion 94 and a connecting portion 96 which is connected to the sheet residual quantity detect portion 94. The sheet residual quantity detect portion 94 is disposed in the vicinity of one end of the connecting portion 96 in such a manner that it is integrally formed with the connecting portion 96. Also, the sheet residual quantity detect portion 94 is engaged with an engaging groove 98 formed in the sheet placement plate 76; and, as will be discussed later, the sheet residual quantity detect portion 94 can be rotated about the connecting portion 96 according to the upward and downward movements of the sheet placement plate 76.

Figure 8:
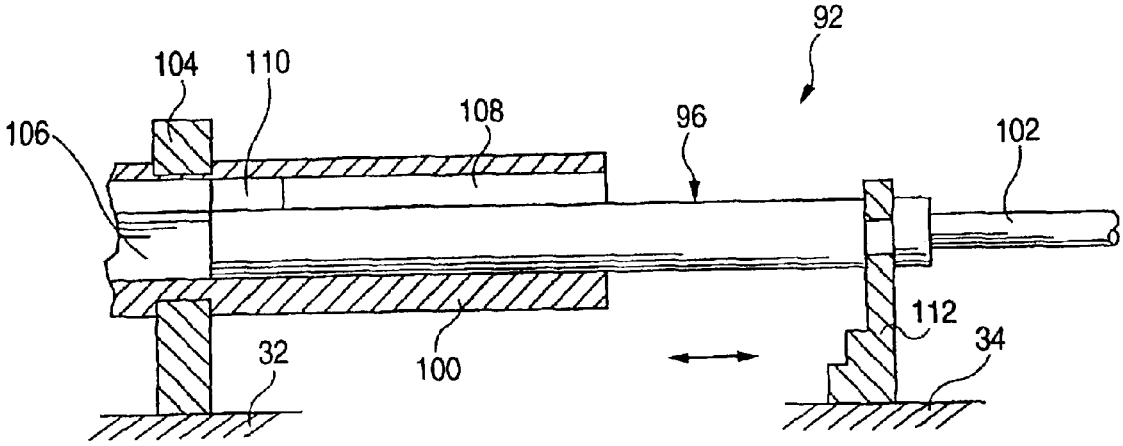
FIG. 8 is a section view of a connecting portion formed in the sheet residual quantity display mechanism used in the sheet supply cassette according to the embodiment of the invention.
Figure 9:
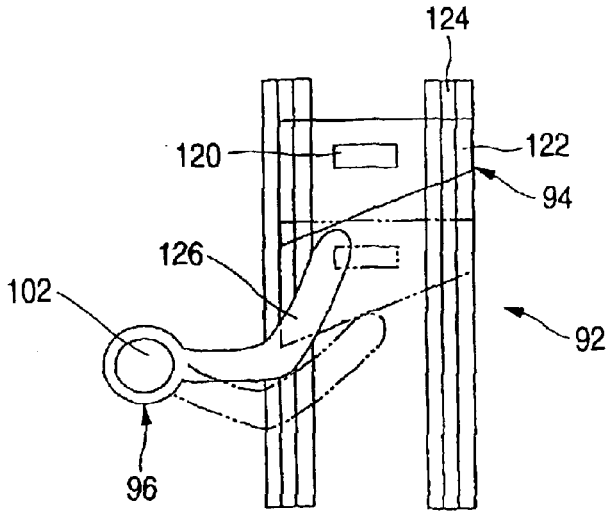
FIG. 9 is a front view of a sheet residual quantity display portion formed in the sheet residual quantity display mechanism of the sheet supply cassette according to the embodiment of the invention.

The connecting portion 96 includes a first rotary shaft 100 in which the sheet residual quantity detect portion 94 is formed, and a second rotary shaft 102 slidably inserted into the first rotary shaft 100. As shown in FIG. 8, the first rotary shaft 100 is supported on a first support portion 104 formed in the main frame body 32 in such a manner that only the rotational motion thereof is allowed. Also, in the first rotary shaft 100, there are formed not only an insertion hole 106 into which the second rotary shaft 102 can be inserted, but also a sliding groove 108 which extends along the insertion hole 106. On the other hand, in the vicinity of one end of the second rotary shaft 102, there is formed a projecting portion 110; and, this projecting portion 110 is slidably inserted into the sliding groove 108. Also, the second rotary shaft 102 is supported on a second support portion 112 formed in the auxiliary frame body 34 in such a manner that only the rotational motion thereof is allowed. Therefore, in case where the auxiliary frame body 34 is moved with respect to the main frame body 32, the second rotary shaft 102 is moved with respect to the first rotary shaft 100 through the second support portion 112 formed in the auxiliary frame body 34. Also, in case where the first rotary shaft 100 is rotated, the second rotary shaft 102 is rotated with the rotation of the first rotary shaft 100.

Above the connecting portion 96, as shown in FIGS. 2 and 3, there is disposed a protection portion 114. This protection wall 114, in the present embodiment, is formed as an eaves-shaped protection wall which projects into the inner surface of the side portion of the auxiliary frame body 34; and thus, the protection wall 114 covers the upper portion of the connecting portion 96 to thereby be able to prevent a user from touching the connecting portion 96 directly. Alternatively, this protection wall 114 can also be structured so as to cover the connecting portion 96 in part or entirely.

The sheet residual quantity display mechanism 92 includes a sheet residual quantity display portion 116. This sheet residual quantity display portion 116 includes a window portion 118 formed in the front surface cover portion 72 of the auxiliary frame body 34, and a display piece 120 which is disposed such that it can be moved within the window portion 118. The display piece 120 is formed integrally with a cam 122. This cam 122 can be slid with respect to, for example, a rail portion 124 formed in the front surface cover portion 72 and can be moved in the vertical direction. The cam 122 includes in the lower surface thereof, for example, a cam surface which is formed so as to be inclined. On the other hand, on the leading end of the second rotary shaft 102 of the connecting portion 94, there is disposed a lever 126 in such a manner that it is formed integrally with the second rotary shaft 102; and, the leading end of the lever 126 is contacted with the cam surface of the cam 122. Therefore, in case where the second rotary shaft 102 is rotated, the lever 126 slides along the cam surface of the cam 122, the cam 122 slides along the rail portion 124, and the display piece 120 moves up and down to display the sheet residual quantity.

By the way, the cam 122 may secure its contact with the lever 126 due to the gravity of the cam 122; or, alternatively, an elastic member may be disposed and the cam 122 maybe energized downwardly by the elastic member.

Next, description will be given below of the operation of the above-mentioned embodiment.

The image carrier body 54 is charged uniformly by the charging device 56, and the light emitted from the light writing device 58 according to the image signal is radiated onto the charged image carrier body 54 to thereby form a latent image. The latent image of the image carrier body 54 formed by the light writing device 58 is visualized by the developing agent of the developing device 60.

On the other hand, one of the sheet supply units 18 is selected by a size signal or the like, sheets stored in one of the sheet supply cassette 22 are fed out therefrom by the nudger roller 24, the sheets are handled by the retard roller 26 and feed roller 28 and transported up to the resist roller 40, the sheets are stopped temporarily by the resist roller, and the sheets are then guided according to a given timing into between the transfer device 62 and image carrier body 54.

In case where the recording medium (sheet) is guided into between the transfer device 62 and image carrier body 54 in this manner, the developing agent on the image carrier body 54 is transferred to the recording medium (sheet) by the transfer device 62. The sheet, to which such developing agent has been transferred, is discharged through the fixing device 64 to the discharge portion 16.

In the sheet supply cassette 22, in case where the residual quantity of sheets piled up on the sheet placement plate 76 decreases gradually, the sheet placement plate 76 rises gradually. In case where the sheet placement plate 76 rises, the sheet residual quantity detect portion 94 of the sheet residual quantity display mechanism 92 engaged with the sheet placement plate 76 is rotated. With the rotation of the sheet residual quantity detect part 94, the connecting portion 96 and lever 126 are rotated together, while the cam 122 is moved downwardly together with the display piece 120 due to the gravity of the cam 122 or due to the energizing force of the elastic member, so that the position of the display piece 120 in the window portion 118 can display the sheet residual quantity.

In case where the auxiliary frame body 34 is expanded and contracted with respect to the main frame body 32, the second rotary shaft 102 is also expanded and contracted with respect to the first rotary shaft 100 to keep the contact between the cam 122 and lever 126, thereby being able to display the sheet residual quantity in the sheet residual quantity display portion 116 with no trouble.

By the way, the sheet residual quantity display mechanism according to the above-mentioned embodiment is an example and there can also be employed another mechanism, provided that it can cope with the expansion and contraction of the auxiliary frame body 34 with respect to the main frame body 32.

As has been described heretofore, according to the invention, in the expandable and contractible sheet supply cassette, since the sheet residual quantity detect portion and sheet residual quantity display portion are connected together through the connecting portion which can be expanded and contracted in linking with the sliding motion of the auxiliary frame body with respect to the main frame body, the sheet residual quantity display portion can be disposed on the auxiliary frame body, which makes it possible to confirm the residual quantity of sheets easily.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A sheet supply cassette, comprising:

a main frame body;

an auxiliary frame body disposed so as to be slidable with respect to said main frame body;

a sheet residual quantity detect portion movable according to the residual quantity of sheets placed; and a sheet residual quantity display portion disposed in said auxiliary frame body for displaying the detect result of said sheet residual quantity detect portion.

2. A sheet supply cassette, comprising:

a main frame body;

an auxiliary frame body disposed so as to be slidable with respect to said main frame body;

a sheet residual quantity detect portion movable according to the residual quantity of sheets placed;

a connecting portion connected to said sheet residual quantity detect portion and movable according to the sliding movement of said auxiliary frame body; and a sheet residual quantity display portion disposed in said auxiliary frame body for displaying the detect result of said sheet residual quantity detect portion.

3. A sheet supply cassette as set forth in claim 2, wherein in said main frame body, there is disposed a sheet placement plate for placing sheets thereon and movable according to the residual quantity of said sheets, and said connecting portion is connected to said sheet placement plate.

4. A sheet supply cassette as set forth in claim 3, wherein said sheet residual quantity detect portion can be rotated according to the movement of said sheet placement plate.

5. A sheet supply cassette as set forth in claim 4, wherein said sheet residual quantity detect portion is rotatably supported on a support portion fixed to said auxiliary frame body.

6. A sheet supply cassette as set forth in claim 5, wherein a lever is disposed on one of said connecting portion and said sheet residual quantity display portion, a cam is disposed on the other, and a display piece is movably disposed on said sheet residual quantity display portion, while the rotation of said sheet residual quantity detect portion can be converted to the movement of said displace piece by said lever and said cam.

7. A sheet supply cassette as set forth in claim 6, wherein said display piece is slidably disposed in a window portion formed in the front surface of said auxiliary frame body.

8. A sheet supply cassette as set forth in claim 2, wherein in said auxiliary frame body, there is disposed a protection portion for protecting said connecting portion.

9. An image forming apparatus comprising at least one sheet supply cassette, said sheet supply cassette comprising:

a main frame body;

an auxiliary frame body disposed so as to be slidable with respect to said main frame body;

a sheet residual quantity detect portion movable according to the residual quantity of sheets placed; and a sheet residual quantity display portion disposed in said auxiliary frame body for displaying the detect result of said sheet residual quantity detect portion.

10. An image forming apparatus, comprising:

an image forming apparatus main body;

image forming means stored in said image forming apparatus main body; and a sheet supply cassette for storing therein sheets to be transported to said image forming means, said sheet supply cassette, comprising:

a main frame body;

an auxiliary frame body disposed so as to be slidable with respect to said main frame body;

a sheet residual quantity detect portion movable according to the residual quantity of sheets placed;

a connecting portion connected to said sheet residual quantity detect portion and movable according to the slidable movement of said auxiliary frame body; and a sheet residual quantity display portion disposed in said auxiliary frame body for displaying the detect result of said sheet residual quantity detect portion, wherein, when said auxiliary frame body is expanded, at least part of said auxiliary frame body is projected further than said image forming apparatus main body on the front surface side of said auxiliary frame body.

* * * * *